US011428000B2

(12) United States Patent
Jung

(10) Patent No.: US 11,428,000 B2
(45) Date of Patent: Aug. 30, 2022

(54) MEANS OF MOUNTING A MAIN CARRIER OF A CEILING LIGHTWEIGHT STEEL STRUCTURE

(71) Applicant: Min Si Jung, Gangneung-si (KR)

(72) Inventor: Min Si Jung, Gangneung-si (KR)

( * ) Notice: Subject to any disclaimer, the term of this patent is extended or adjusted under 35 U.S.C. 154(b) by 0 days.

(21) Appl. No.: 17/079,253

(22) Filed: Oct. 23, 2020

(65) Prior Publication Data

US 2021/0332588 A1 Oct. 28, 2021

(30) Foreign Application Priority Data

Apr. 22, 2020 (KR) ..... 10-2020-0048985

(51) Int. Cl.
*E04B 9/20* (2006.01)
*E04B 9/06* (2006.01)

(52) U.S. Cl.
CPC . *E04B 9/20* (2013.01); *E04B 9/06* (2013.01)

(58) Field of Classification Search
CPC ... E04B 9/06; E04B 9/18; E04B 9/183; E04B 9/20; E04B 9/006; E04B 9/0478; E04B 9/16
See application file for complete search history.

(56) References Cited

U.S. PATENT DOCUMENTS 2,376,279 A * 5/1945 Schlenkert ..... E04B 9/20 52/509
2,659,807 A * 11/1953 Wakefield ..... E04B 9/34 362/150
2,915,275 A * 12/1959 Korka ..... E04B 9/20 248/327
3,066,904 A * 12/1962 Cook ..... F21S 2/00 248/62
3,402,517 A * 9/1968 Halfaker ..... E04B 9/22 52/126.5
3,426,489 A * 2/1969 Lambert ..... E04B 9/22 52/39
3,950,909 A * 4/1976 Brugman ..... E04B 9/34 52/773

(Continued)

FOREIGN PATENT DOCUMENTS

GB 2172626 A * 9/1986 ..... E04D 3/3602
JP S50-030816 Y 9/1975

(Continued)

*Primary Examiner* — James M Ference
(74) *Attorney, Agent, or Firm* — Maschoff Brennan

(57) ABSTRACT

Disclosed is a main carrier mounting mechanism having a ceiling lightweight steel structure, which includes: an upper horizontal portion mounted on a rod hanger; having an upper end integrally coupled to one end of the upper horizontal portion and a lower end extending downward; a lower panel having one end integrally coupled to the lower end of the main standing portion and having an opposite end extending parallel to the upper horizontal portion; and a lower standing portion having a lower end integrally coupled to the opposite end of the lower panel, and an upper end extending toward an opposite end of the upper horizontal portion, and further includes a main carrier separation prevention fastener having one end integrally coupled to the upper end of the lower standing portion and an opposite end extending toward the opposite end of the upper horizontal portion and extending toward the main standing portion.

7 Claims, 8 Drawing Sheets

(56) References Cited

U.S. PATENT DOCUMENTS 4,027,446 A * 6/1977 Brugman ..... E04B 9/34
52/506.08
4,101,103 A * 7/1978 Mooney ..... F16L 3/11
248/62
4,614,072 A * 9/1986 Price ..... E04B 9/10
411/433
4,671,811 A * 6/1987 Cadwell, Jr. ..... F24F 8/10
55/355
5,946,875 A * 9/1999 Jeanseau ..... E04B 9/22
52/506.08
6,298,623 B1 * 10/2001 Wendt ..... E04B 9/006
248/343
6,453,633 B1 * 9/2002 Wilkinson, Jr. ..... E04B 9/006
40/601
6,637,710 B2 * 10/2003 Yaphe ..... E04B 9/006
248/342
7,374,057 B2 * 5/2008 Hendrickson ..... H02G 3/34
220/3.9
8,057,077 B2 * 11/2011 Gagne ..... F21V 21/02
362/147
9,745,746 B2 * 8/2017 Heesbeen ..... E04B 9/16
10,227,776 B2 * 3/2019 Mayer ..... E04B 9/065
10,233,640 B1 * 3/2019 Russell ..... E04B 9/18
2002/0060280 A1 * 5/2002 Yaphe ..... E04B 9/006
248/317
2003/0213199 A1 * 11/2003 Bongio ..... E04B 9/183
52/506.01
2006/0102820 A1 * 5/2006 Boville ..... F16B 7/22
248/300
2010/0006736 A1 * 1/2010 Jager ..... E04B 9/20
248/562
2014/0061417 A1 * 3/2014 Maisch ..... E04B 9/16
248/327
2019/0316351 A1 * 10/2019 Jung ..... E04B 9/10

FOREIGN PATENT DOCUMENTS

JP 2014-088711 A 5/2014
JP 2015073856 A 4/2015
JP 2019-027273 A 2/2019
KR 20-0188639 Y1 7/2000
KR 10-2019-0119570 A 10/2019

* cited by examiner

MEANS OF MOUNTING A MAIN CARRIER OF A CEILING LIGHTWEIGHT STEEL STRUCTURE

BACKGROUND OF THE INVENTION

1. Field of the Invention

The present invention relates to a main carrier mounting mechanism having a ceiling lightweight steel structure.

2. Description of the Prior Art

A ceiling lightweight steel structure refers to a structure installed for the purpose of supporting and distributing loads for construction of various finishing materials in a building.

A tile may be used by cutting and processing a metal, such as aluminum or galvanized steel sheet, or by injection-molding plastic materials.

The tile may express a unique color and texture on a surface thereof, may express various types of patterns and gloss in various manners such as surface treatment, powder coating, embossing, and perforation treatment, may have high durability and excellent process ability, may be easily cleaned, may have excellent stain resistance, may prevent harmful dust such as asbestos from being generated, and may be molded from recyclable metal or plastic materials to be environmentally friendly. Accordingly, recently, the tile is widely used as an interior finishing material for various buildings.

The tile is installed on an indoor ceiling using a ceiling tile structure. As shown in FIG. 1, the ceiling tile structure includes a rod hanger 1, a main carrier hanger 2 mounted on the rod hanger 1, a main carrier 3 inserted and mounted to the main carrier hanger 2, a clip-type carrier 6 arranged crosswise on the main carrier 3, a clip hanger 5 for connecting the main carrier 2 and the clip-type carrier 6 to each other, and a tile 4 interposed in a space partitioned and defined by the main carrier 2 and the clip-type carrier 6.

Recently, since there is a trend of installing a heavy interior item on a ceiling, an excessive load may be applied to the main carrier 3 to deform the main carrier hanger 2 supporting the main carrier 3, thereby failing to properly support the main carrier 3.

In addition, a worker may step on the main carrier 3 or the clip-type carrier 6 during ceiling tile construction. At this time, since the main carrier hanger 2 supporting the main carrier 3 is opened in one direction, the main carrier 3 cannot be properly supported and thus deformation occurs.

In addition, when the main carrier 3 is inserted into a plurality of main carrier hangers 2 arranged in a row, and the main carrier hangers 2 are not arranged in a straight line, it is difficult to adjust a length of the rod hanger 1, and accordingly, the main carrier 3 may fail to be inserted into the main carrier hangers 2.

Further, when the main carrier 3 is inserted into the plurality of main carrier hangers 2, the main carrier 3 passes through left and right sides of the main carrier hanger 2 to insert another pin to prevent the main carrier 3 from being separated upward from a plurality of main carrier hangers 2. Accordingly, the efficiency of work is deteriorated.

In addition, when the full thread bolt is used instead of the rod hanger, two nuts may be engaged with each other to adjust the height of the main carrier hanger 2.

At this time, the nut is easily and frequently loosened due to shock and vibration.

SUMMARY OF THE INVENTION

The present invention is provided to solve the above-described problems.

The main carrier mounting mechanism according to the present invention includes: an upper horizontal portion (110) mounted on a rod hanger (10); a main standing portion (120) having an upper end integrally coupled to one end of the upper horizontal portion (110) and a lower end extending downward in a direction of gravity to have a length longer than a height of a main carrier (2); a lower panel (130) having one end integrally coupled to the lower end of the main standing portion (120), and an opposite end formed to have a width equal to a width of the main carrier (2) so that the main carrier (2) is seated thereon; and a separation prevention fastener (150) connected to the opposite end of the lower panel (130) and extending toward an opposite end of the upper horizontal portion (110) so as to define an open space, wherein the separation prevention fastener (150) includes a first cut-off weak portion (153) at a part of a lower end thereof, so that the separation prevention fastener (150) is coupled to the upper horizontal portion (110) manually in a male-female coupling manner. Thus, the above problems can be solved.

According to the present invention, a full thread bolt fixed to ceiling concrete; a tubular adjustment portion in which an outer surface of an upper end of the tubular adjustment portion is connected to and fastened into the full thread bolt, a flange fixedly circumscribed to a lower end of the tubular adjustment portion with an outer diameter larger than a size of the through-hole to prevent the tubular adjustment portion from exiting from a through-hole toward the ceiling in a state in which the tubular adjustment portion passes through the through-hole formed in the upper horizontal portion; a nut-type hole formed in the upper end of the tubular adjustment portion while being formed through a screw processing portion formed on the upper end of the tubular adjustment portion in a radial direction; and a bolt fastened to the nut-type hole may be provided in the rod hanger in addition to the main carrier separation prevention fastener.

According to the technical solution as described above of the present invention, after the main carrier is inserted into the body of the main carrier hanger while the main carrier separation prevention fastener is opened, the main carrier separation prevention fastener is retracted, so as to be coupled with the upper horizontal portion of the body in a male/female manner, so that the constructability can be improved.

In addition, even when an excessive load is applied to the main carrier, the body of the main carrier hanger supporting the main carrier can be prevented from being deformed, and the main carrier can be stably supported while preventing the main carrier from being separated.

In addition, even when bodies of a plurality of main carrier hangers are not arranged in a straight line, the height may be adjusted by the tubular adjustment portion and then the main carrier may be inserted and the main carrier separation prevention fastener may be coupled, so that the field response constructability can be improved.

In addition, when the main carrier is inserted into bodies of a plurality of main carrier hangers, conventional bolts, which are provided to prevent the main carrier from being separated upward from the bodies of the main carrier hangers, are excluded and bolt fastening work or pin bonding work conventionally performed is also excluded, so that work efficiency for constructing the main carrier can be significantly increased. Further, the number of parts may be reduced, so that manufacturing costs can be significantly reduced.

In addition, according to the present invention, the height of the main carrier can be easily adjusted by the rod hanger, and the tubular adjustment portion can be prevented from being disassembled from the full thread bolt even when an earthquake occurs.

DETAILED DESCRIPTION OF THE EXEMPLARY EMBODIMENTS

Hereinafter, a main carrier mounting mechanism according to one embodiment of the present invention will be described in detail with reference to FIGS. 2 and 3.

Figure 2:
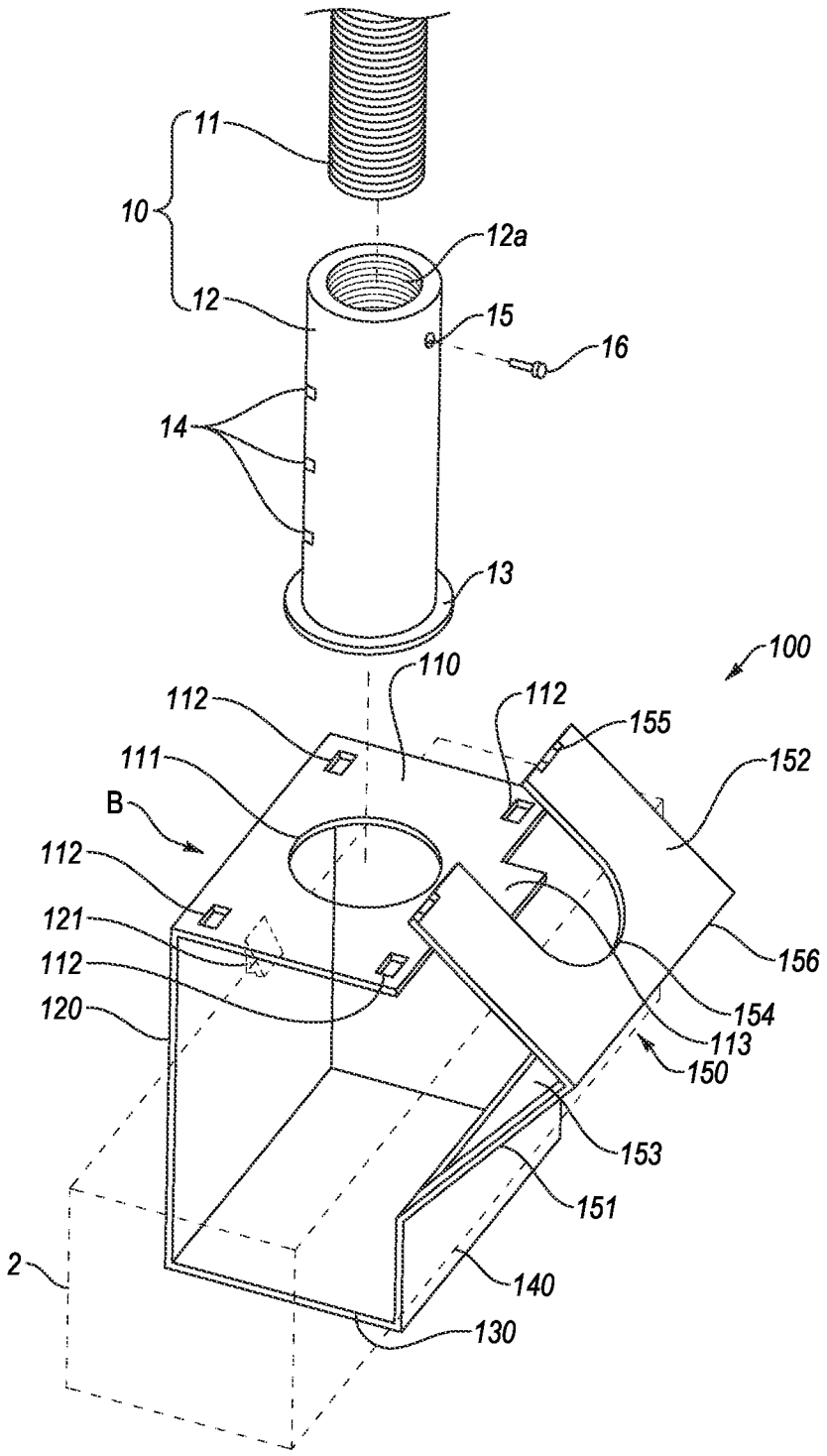
FIG. 2 is an exploded perspective view showing the mounting mechanism of a main carrier according to the embodiment of the present invention.
Figure 3:
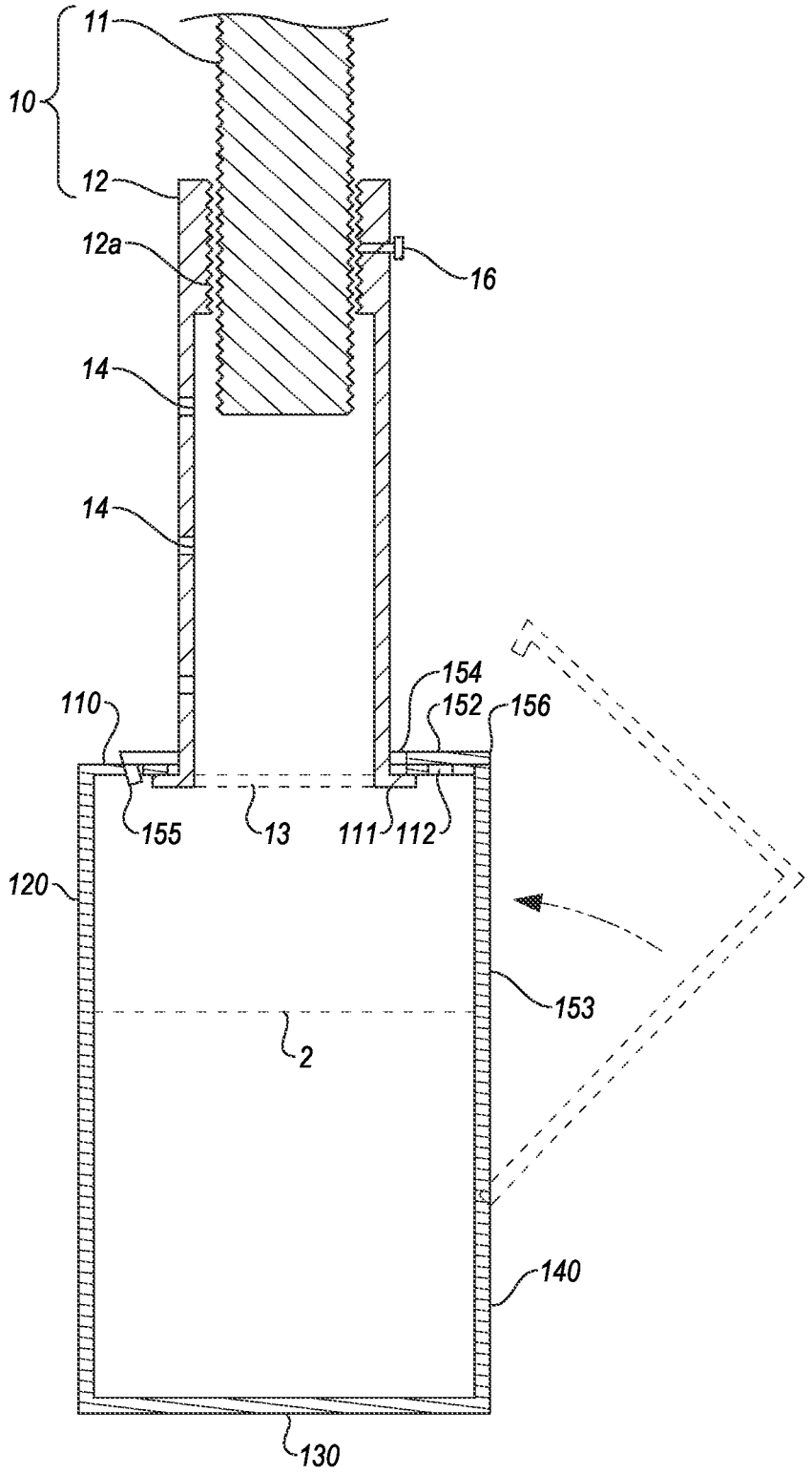
FIG. 3 is a combined sectional view of FIG. 2.

In FIGS. 2 and 3, the main carrier mounting mechanism of the present embodiment is indicated by reference numeral 100.

Figure 1:
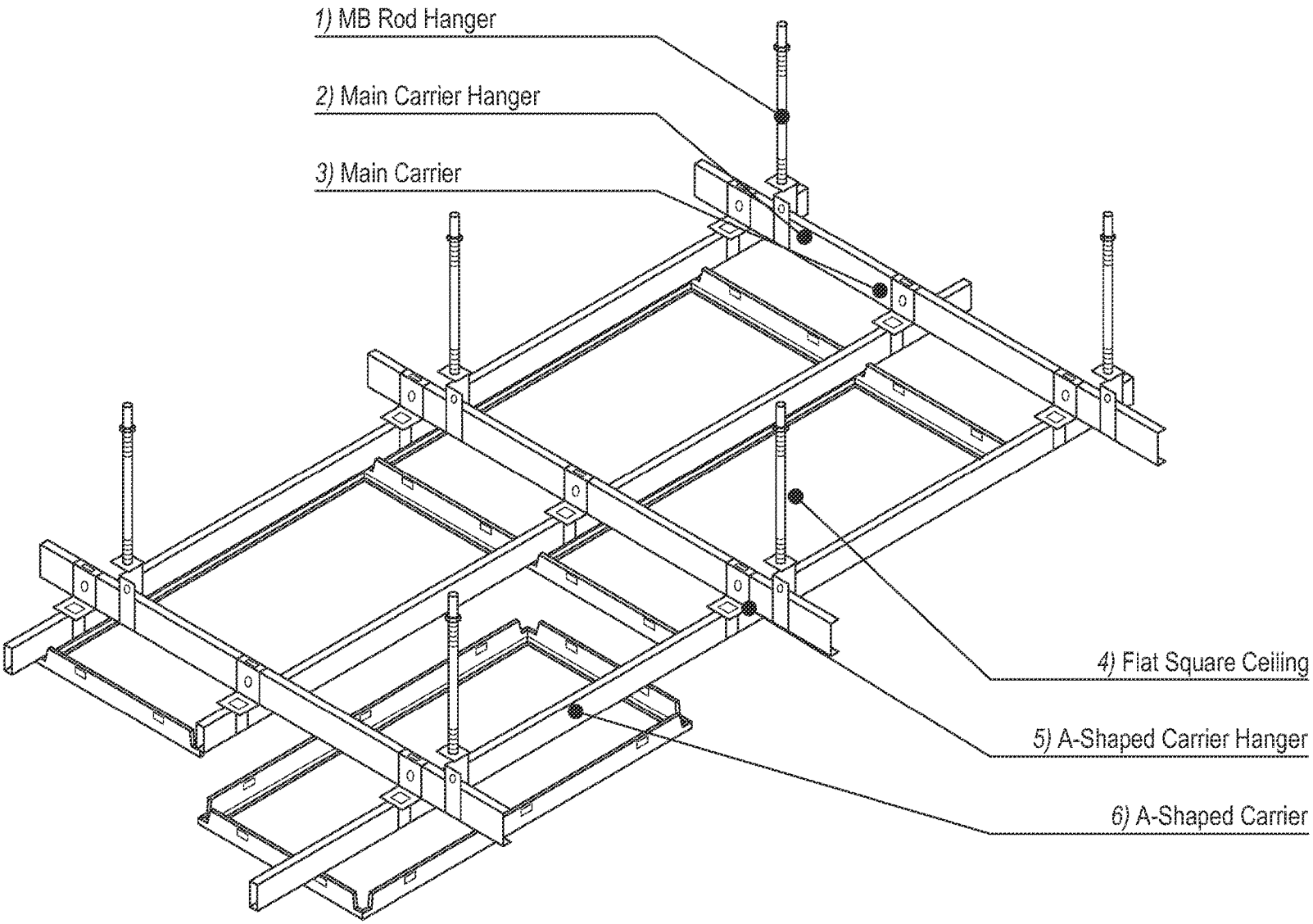
FIG. 1 is a view showing a conventional tile structure.

As shown in FIGS. 1 to 3, the main carrier mounting mechanism 100 includes: an upper horizontal portion 110 mounted on a rod hanger 10; a main standing portion 120 having an upper end integrally coupled to one end of the upper horizontal portion 110 and a lower end extending downward in a direction of gravity to have a length longer than a height of a main carrier 2; a lower panel 130 having one end integrally coupled to the lower end of the main standing portion 120, and an opposite end extending parallel to the upper horizontal portion 110 to have a length equal to a width of the main carrier 2; and a lower standing portion 140 having a lower end integrally coupled to the opposite end of the lower panel 130, and an upper end extending toward an opposite end of the upper horizontal portion 110 to have a length shorter than the height of the main carrier 2, includes a main carrier hanger having a body B with channel-type section, further include a main carrier separation prevention fastener 150 having one end integrally coupled to the upper end of the lower standing portion 140 and an opposite end extending toward the opposite end of the upper horizontal portion 110, and extending toward the main standing portion 120 so that a lower surface of the main carrier separation prevention fastener 150 comes into surface-contact with an upper surface of the upper horizontal portion 110 so as to be coupled to the upper horizontal portion 110 in a male/female manner.

In addition, the rod hanger 10 includes: a full thread bolt 11 (not shown) fixed to ceiling concrete; a tubular adjustment portion 12 in which an outer surface of an upper end of the tubular adjustment portion 12 is connected to and fastened into the full thread bolt 11, a flange 13 formed at a lower end of the tubular adjustment portion 12, having an outer diameter larger than a size of the through-hole 111, and having a penetrated center through which the full thread bolt 11 passes, to prevent the tubular adjustment portion 12 from exiting from a through-hole 111 toward the ceiling in a state in which the tubular adjustment portion 12 passes through the through-hole 111 formed in a center of the upper horizontal portion 110; a plurality of observation through-holes 14 formed in the tubular adjustment portion 12 at intervals in a longitudinal direction of the tubular adjustment portion 12; a nut-type hole 15 formed in the upper end of the tubular adjustment portion 12 while being formed through a screw processing portion 12*a* formed on the upper end of the tubular adjustment portion 12 in a radial direction; and a bolt 16 fastened to the nut-type hole 15 to come into contact with a tip of the full thread bolt 11 to prevent the tubular adjustment portion 12 from being rotated relative to the full thread bolt 11, so that the tubular adjustment portion 12 is prevented from being unintentionally disassembled from the full thread bolt 11.

The screw processing portion 12*a* of the tubular adjustment portion 12 is formed only at the upper end of the tubular adjustment portion 12, such that the tubular adjustment portion 12 is quickly fastened to and released from the full thread bolt 11 without requiring a large force of the worker, so as to reduce fatigue of the worker.

From the above aspect, preferably, an inner diameter of an inner circumferential surface of the tubular adjustment portion 12 positioned below a screw processing portion 12*a* of the tubular adjustment portion 12 may be larger than an inner diameter of the screw processing portion 12*a*.

The observation through-holes 14 are formed in the tubular adjustment portion 12, such that the degree of insertion of the full thread bolt 11 into the tubular adjustment portion 12 can be easily checked.

The horizontal portion 110 is formed in a center thereof with a through-hole 111, and formed at four corners thereof with female holes 112 corresponding to at least one pair of male parts 155.

The main carrier separation prevention fastener 150 integrally includes a first piece 151 having one end integrally coupled to the upper end of the lower standing portion 140 and an opposite end extending toward the opposite end of the upper horizontal portion 110, and a second piece 152 bent at the top of the first piece 151 and extending toward the main standing portion 120 such that a lower surface of the second piece 152 comes into surface-contact with an upper surface of the upper horizontal portion 110.

Figure 6C:
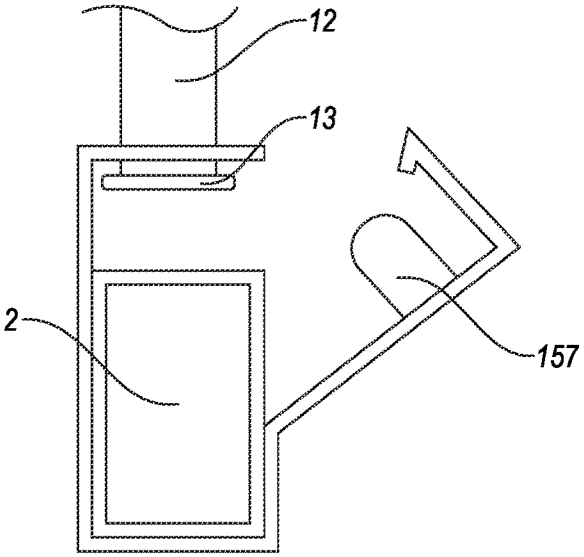
FIGS. 6A, 6B, and 6C show a perspective view, a sectional view, and a combination view, respectively, showing a fixing piece according to the embodiment of the present invention.
Figure 6B:
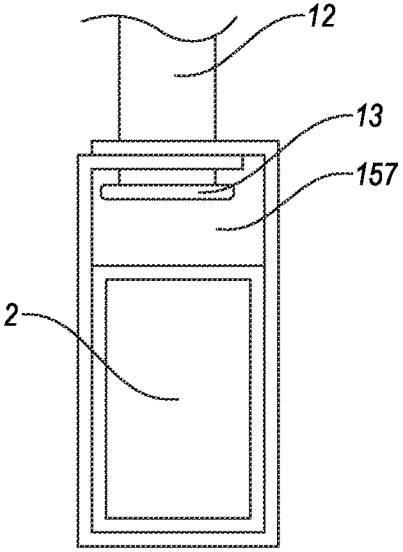
Figure 6A:
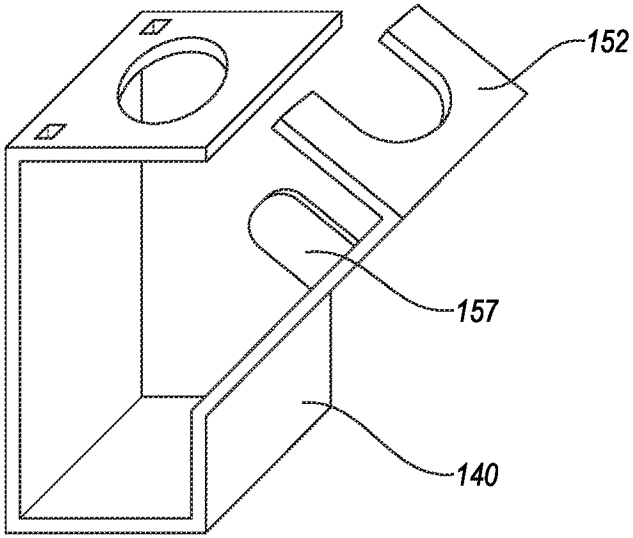
Figure 7A:
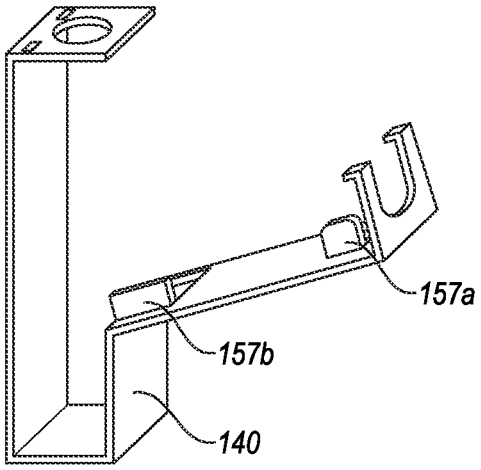
FIGS. 7A, 7B, 7C, and 7D are perspective views and construction views showing a fixing piece according to still another embodiment of the present invention.
Figure 7B:
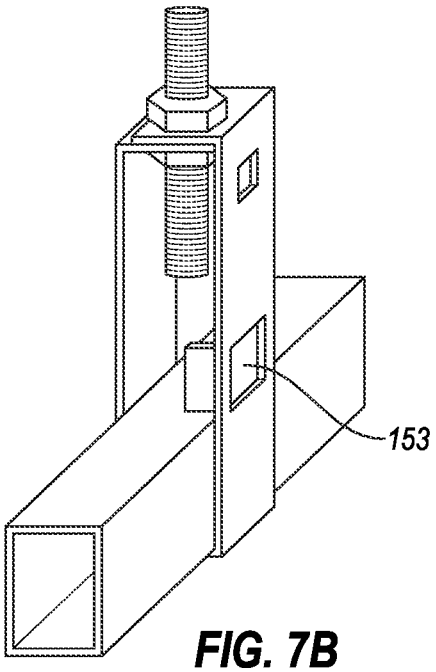
Figure 7C:
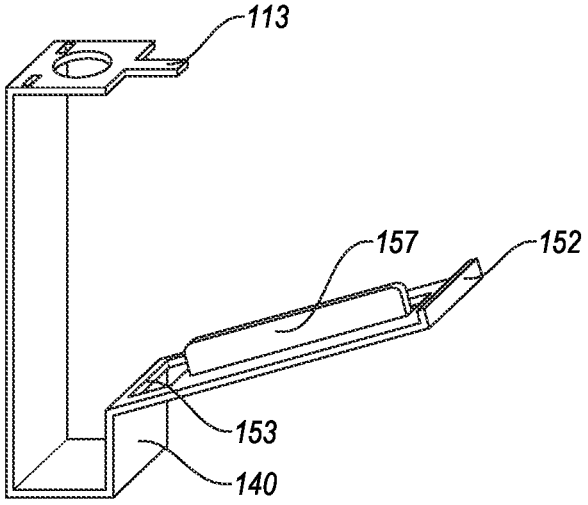
Figure 7D:
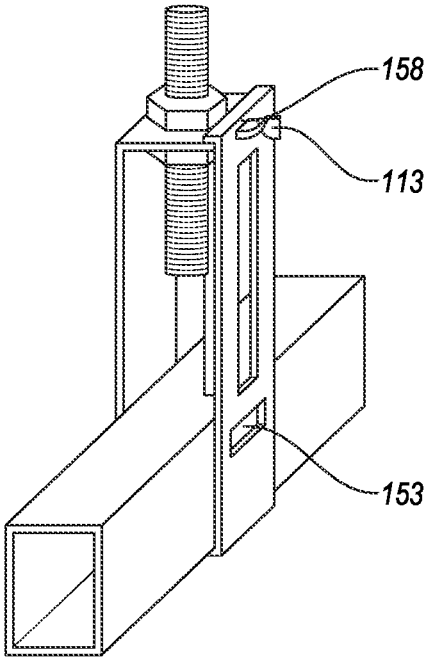

In addition, as shown in FIGS. 6A, 6B, and 6C, a fixing piece 157 protrudes inward on an inner surface of the main carrier separation prevention fastener 150 so as to be fitted to a space between the flange 13 of the rod hanger 10 and an upper end of the main carrier 2, thereby preventing the main carrier 2 from moving upward and the main carrier mounting mechanism 100 from moving upward.

In addition, when the main carrier separation prevention fastener 150 is fastened to a body B, an upper fixing piece 157*a* is provided on an inner surface of a first piece 151 to fill a space together with one surface of the flange 13 of a lower end of the rod hanger 10 or fill the space together with one surface of a height adjustment nut 13*a*, so that the tubular adjustment portion 12 or the nut 13*a* is prevented from being rotated when the separation prevention fastener 150 is coupled to the upper horizontal portion 110 in a male/female manner.

In addition, the fixing piece 157 may be divided into an upper fixing piece 157*a* for supporting the flange 13 of the rod hanger 10, and a lower fixing piece 157*b* for preventing the main carrier 2 from moving upward.

It may be preferable that design of the fixing piece 157 is configured to be manufactured in a direction parallel to the main standing portion 120.

The first piece 151 is formed with a first cut-off weak portion 153 to enable the first piece 151 to be bent with respect to the lower standing portion 140, so that the first piece 151 is pressed to push the main carrier separation prevention fastener 150 toward the upper horizontal portion 110, so as to couple the female holes 112 to the pair of male parts 155.

The second piece 152 is formed with an avoiding part 154 for enabling the coupling while avoiding the tubular adjustment portion 12.

Figure 8B:
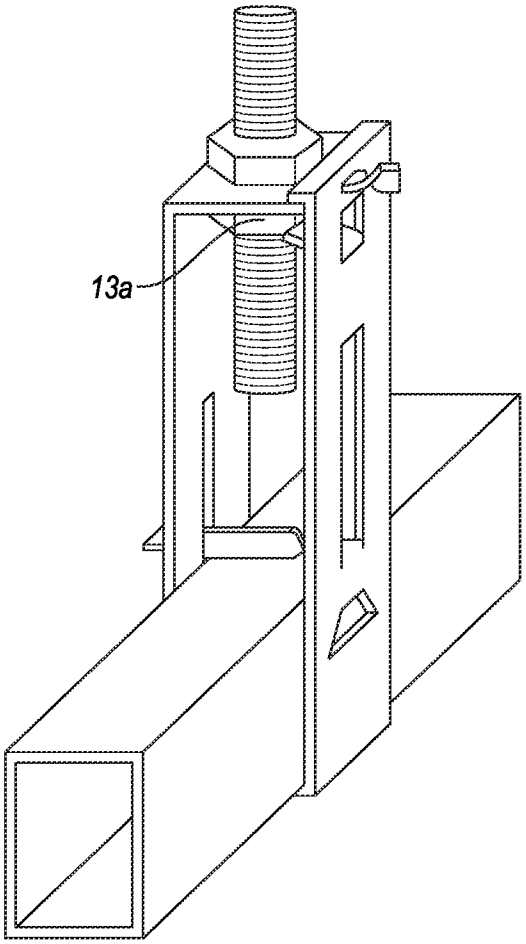
FIGS. 8A and 8B is a perspective view and a fastening view, respectively, showing a main carrier mounting mechanism according to still another embodiment of the present invention.
Figure 8A:
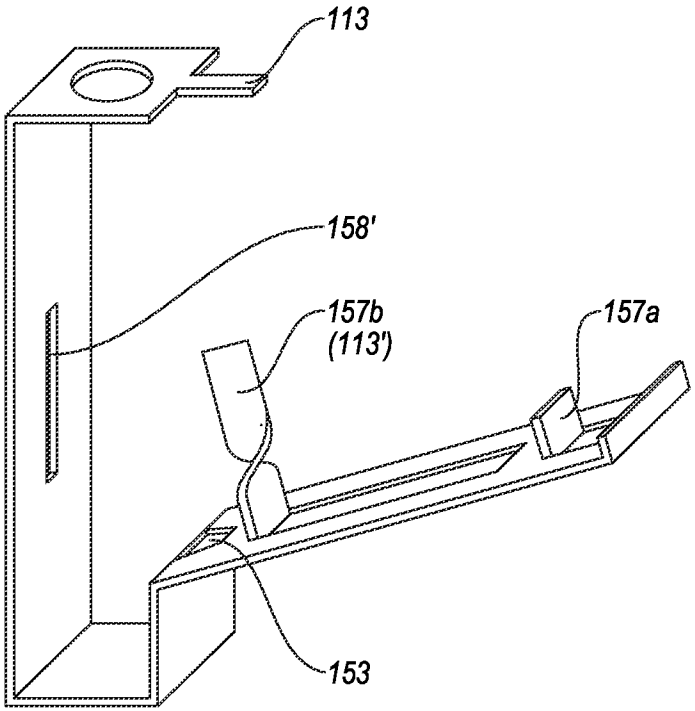

In addition, as shown in FIG. 8A, in an upper side surface of the side of the main carrier separation prevention fastener 150, the upper horizontal portion 110 is formed with a protruding piece 113 in the direction of the main carrier separation prevention fastener 150 to enable the upper horizontal portion 110 to be horizontally fastened, and a fastening hole 158 is formed on the upper side surface of the main carrier separation prevention fastener 150 so as to be mutually fastened to the protruding piece 113.

The fastening may be stronger by twisting even after the fastening to prevent the separation.

In addition, as shown in FIG. 8A, the protruding piece 113 is directed toward a middle inner axis of the main carrier separation prevention fastener 150, and the fastening hole 158 is directed to correspond to a middle part of the main standing portion 120 of the body B, so that the body B may be prevented from spreading and the main carrier 2 may also be prevented from moving upward.

In addition, a pair of male parts 155 having a shape coupled to the female holes 112 of the upper horizontal portion 110 in a male-female manner and inclined downward toward a base end of the second piece 152 are formed on both sides of the tip of the second piece 152.

The lower standing portion 140 and the lower panel 130 have strength to maintain the shape even by an unintentional external force after the main carrier 2 is inserted into the body B so as to prevent the main carrier 2 from being separated from the body B toward the lower standing portion 140. In addition, the first cut-off weak portion 153 of the first piece 151 is easily deformed by the force of the worker, thereby functioning to allow the tip of the second piece 152 to approach the female hole 112 of the upper horizontal portion 110, or functioning to fasten the protruding piece 113 to the fastening hole 158.

Figure 4C:
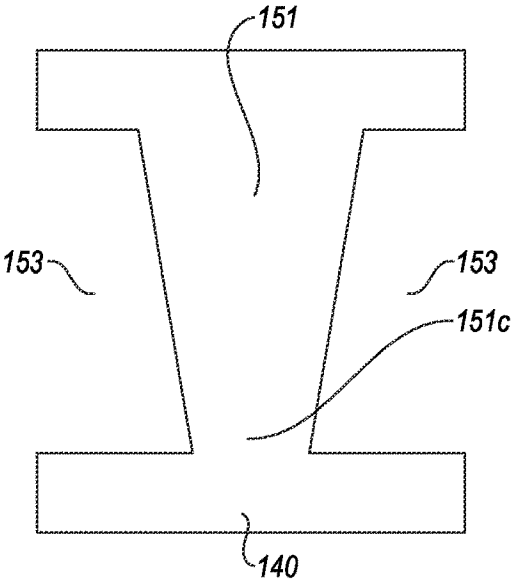
FIGS. 4A, 4B, and 4C are side views showing a first piece and a first cut-off weak portion of FIG. 2 according to the embodiment.
Figure 4B:
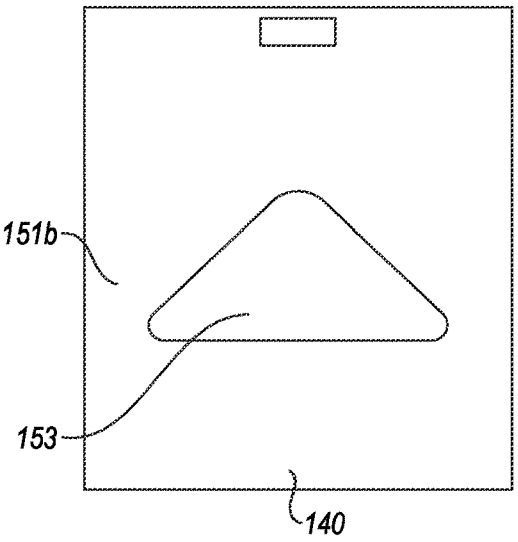
Figure 4A:
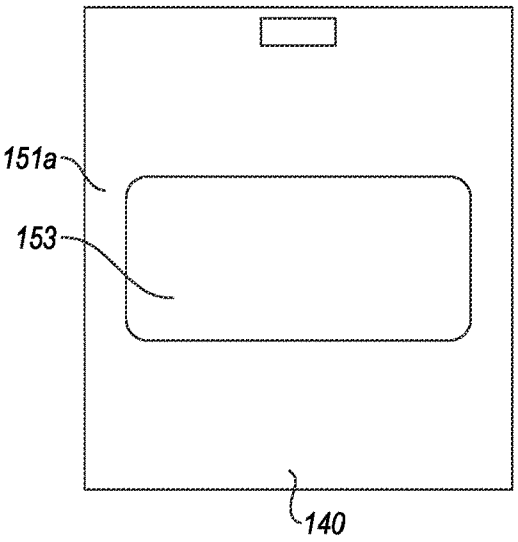

The first cut-off weak portion 153 may have a rectangular shape as shown in FIG. 4A, may have a triangular shape as shown in FIG. 4B, in which a base line is positioned at the bottom and three vertices are chamfered, or may have an "I" shape as shown in FIG. 4C. In order to form a weak portion to manually operate the main carrier separation prevention fastener 150, the present invention is not limited to the shape.

In the case that the first cut-off weak portion 153 has a triangular shape in which three vertices are chamfered, and when the worker presses a region of the first piece 151 adjacent to an upper vertex region, the vertex regions may be easily bent at the same time because the region of the first piece 151*b* adjacent to the vertices on both sides of the bottom is the most weak. When the region of the first piece 151 is formed with the same area as the first piece 151*a*, the bending may be repeated several times because the bent portion is dispersed.

The bent portion 156 is formed between the upper end of the first piece 151 and the base end of the second piece 152, so as to support the load balanced with the main carrier separation prevention fastener 150 by distributing the unbalanced load applied to the upper horizontal portion 110 to the second piece 152.

Figure 5A:
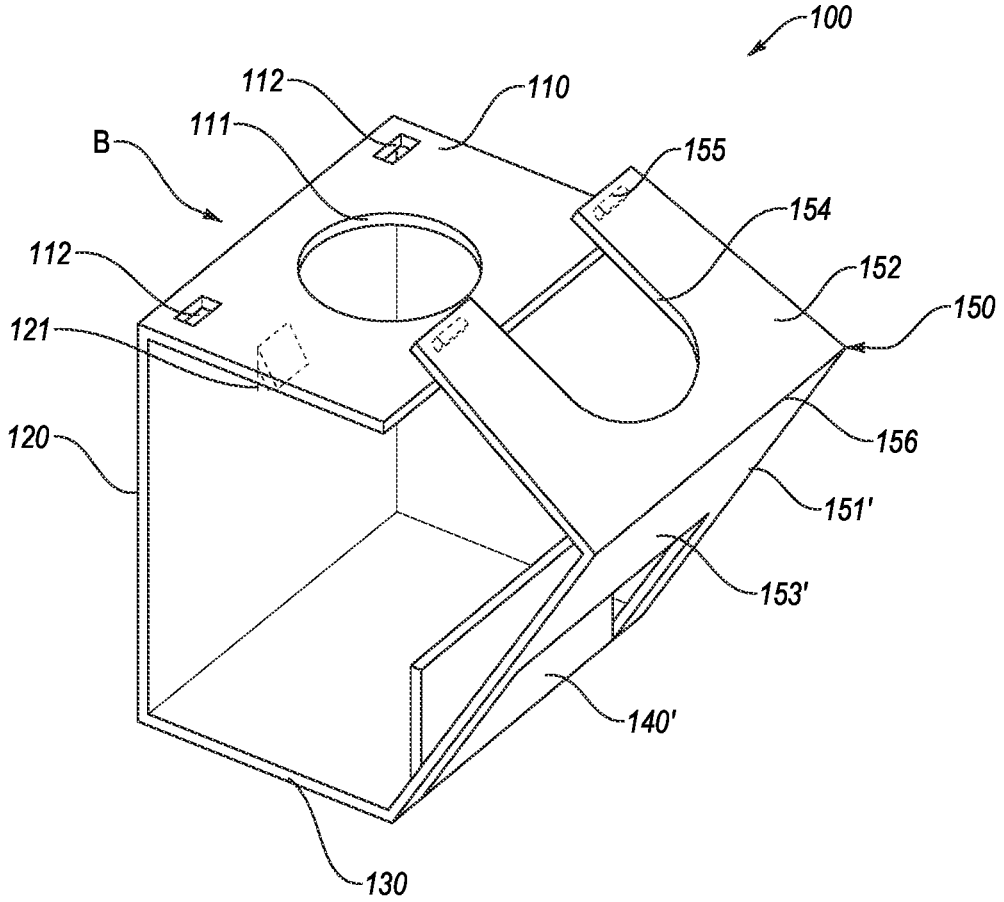
FIGS. 5A and 5B show a perspective view and a side view, respectively, of the first piece of FIG. 2 according to another embodiment.
Figure 5B:
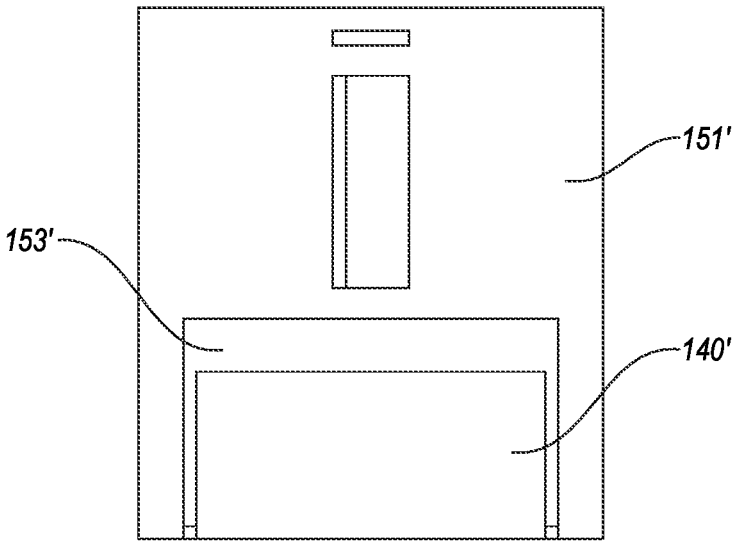

Further, in the above embodiment although the lower panel 130, the lower standing portion 140, and the first piece 151 have been shown and described as having the same width, the present invention is not limited thereto. In another embodiment, as shown in FIG. 5A, in a state where a lower standing portion 140' has a width smaller than the lower panel 130, a lower end of the first piece 151' may be integrally coupled to both sides of the opposite end of the lower panel 130, and an inverted U-shaped cut-out weak portion 153' surrounding the lower standing portion 140' may be formed on the first piece 151', such that the first piece 151' may be bent with respect to the lower panel 130.

In the above embodiment, it is preferable in that the first portion 151' is transformed into various postures than the first part 150 while the lower standing portion 140', like the lower standing portion 140, functions as a support to prevent the mail carrier 2 from being separated, so that the pair of male parts 155 can be easily coupled in a male-female manner.

The main carrier mounting mechanism 100 configured in the above manner may be operated as follows.

After the main carrier 2 is inserted into the body B of the main carrier hanger in the state where the main carrier separation prevention fastener 150 is opened, the main carrier separation prevention fastener 150 may be retracted to be coupled to the upper horizontal portion 110 of the body B in the male-female manner. Accordingly, even when an excessive load is applied to the main carrier 2, the body B of the main carrier hanger supporting the main carrier 2 may be prevented from being deformed, so that the main carrier 2 may be stably supported while preventing the main carrier 2 from being separated. Even when bodies B of a plurality of main carrier hangers are not arranged in a straight line, the main carrier may be inserted after the height of the rod hanger 10 is adjusted by the tubular adjustment portion 12, and the main carrier separation prevention fastener may be coupled, so that the main carrier 2 can be inserted into the bodies B of the main carrier hangers. When the length of the main carrier mounting mechanism 100 is vertically elongated, the left main standing portion 120 and the first piece 151 may be prevented from being opened. In addition, when the main carrier 2 is inserted into bodies B of a plurality of main carrier hangers, the main carrier 2 may prevented from moving upward in the bodies B of the main carrier hangers and the bodies B may be prevented from moving upward at the same time. Further, the provided conventional bolt and fixing pin may be unnecessary and the conventional bolt and fixing pin fastening work may also be unnecessary, so work efficiency for constructing the main carrier can be significantly increased, the strength can be increased, and the number of parts can be reduced, so that manufacturing costs can be significantly reduced. It is provided to support the load balanced with the main carrier separation prevention fastener 150.

In addition, the height of the main carrier 2 may be easily adjusted by the rod hanger 10, the tubular adjustment portion 12 may be prevented from being disassembled from the full thread bolt 11 even when an earthquake occurs.

In the above embodiment, the female holes 112 are formed at four corners of the upper horizontal portion 110. In addition, although the pair of male parts 155 coupled in the male-female manner to the two female holes 112 arranged side by side in the longitudinal direction of the main carrier 2 among the female holes 112 formed in the four corners have been described as being formed on the second piece 152 of the main carrier separation prevention fastener 150, the present invention is not limited thereto. One female hole 112 may be formed in the upper horizontal portion 110, and correspondingly, one male part 155 may be formed on the second piece 152 of the main carrier separation prevention fastener 150.

In addition, the protruding piece 113 formed on the upper horizontal portion 110 of the body B and the fastening hole 158 formed in the first piece 151 are configured to enable the main carrier separation prevention fastener 150 to be retracted and tighten strongly toward the body B. The quantity and position are not limited.

In addition, according to the above embodiment, although it has been described that the female hole 112 is formed in the upper horizontal portion 110, and the male part 155 coupled to the female hole 112 in the male-female manner is formed on the second piece 152 of the main carrier separation prevention fastener 150, the present invention is not limited thereto. The female hole 112 may be formed in the second piece 152 of the main carrier separation prevention fastener 150, and the male part 155 may be formed on the upper surface of the upper horizontal portion 110.

In addition, according to the above embodiment, although the main standing portion 120 has been described as being free from the cut-off weak portion, the present invention is not limited thereto. A bendability may be applied to the main standing portion 120 to provide an easy male-female coupling between the male part 155 and the female hole 112, and a weak portion (not shown) similar to the first cut-off weak portion 153 of the first piece 151 of the main carrier separation prevention fastener 150 may be formed on a region of the main standing portion 120 positioned under a protruding part 121.

What is claimed is:

1. A main carrier mounting mechanism for a concrete ceiling, the main carrier mounting mechanism having a lightweight steel structure, the main carrier mounting mechanism comprising:

an upper horizontal portion mounted on a rod hanger;

a main standing portion having an upper end integrally coupled to one end of the upper horizontal portion and a lower end extending downward in a direction of gravity to have a length longer than a height of a main carrier;

a lower panel having one end integrally coupled to the lower end of the main standing portion, and an opposite end formed to have a width equal to a width of the main carrier so that the main carrier is seated thereon; and a separation prevention fastener connected to the opposite end of the lower panel and extending toward an opposite end of the upper horizontal portion so as to define an open space, wherein:

the separation prevention fastener includes a first cut-off weak portion at a part of a lower end thereof, so that the separation prevention fastener is coupled to the upper horizontal portion in such manner that a female element of the upper horizontal portion receives a male member of the separation prevention fastener, or a female element of the separation prevention fastener receives a male member of the upper horizontal portion, when the separation prevention fastener is fastened to a body of the main carrier, a fixing piece is provided on an inner surface of a first piece of the separation prevention fastener and fitted between a flange of a tubular adjustment portion at a lower end of the rod hanger and an upper end of the main carrier so as to prevent the main carrier and the main carrier mounting mechanism from moving.

2. The main carrier mounting mechanism of claim 1, wherein the rod hanger includes:

a full thread bolt fixed to a concrete ceiling, wherein an outer surface of an upper end of the tubular adjustment portion is connected to and fastened into the full thread bolt, and wherein the flange is fixedly circumscribed to a lower end of the tubular adjustment portion with an outer diameter larger than a size of the through-hole to prevent the tubular adjustment portion from exiting from a through-hole toward the concrete ceiling in a state in which the tubular adjustment portion passes through the through-hole formed in a center of the upper horizontal portion, so that a height is adjustable by rotating the tubular adjustment portion.

3. The main carrier mounting mechanism of claim 2, wherein the tubular adjustment unit is formed with an observation through-hole therein for confirming a safety coupling of the full thread bolt, or formed with a threaded hole therein for allowing the full thread bolt to be pressed and fixed.

4. The main carrier mounting mechanism of claim 2, wherein an inner diameter of an inner circumferential surface of the tubular adjustment portion positioned below a screw processing portion of the tubular adjustment portion is larger than an inner diameter of the screw processing portion.

5. The main carrier mounting mechanism of claim 1, wherein the fixing piece includes an upper fixing piece for supporting the lower end of the rod hanger and a lower fixing piece for preventing the main carrier from moving upward.

6. The main carrier mounting mechanism of claim 1, wherein, when the upper horizontal portion is coupled to the separation prevention fastener in such manner that the female element receives the male member, at least one protruding piece is provided at a part of the opposite end of the upper horizontal portion and a fastening hole is formed in the separation prevention fastener so as to be mutually coupled to the protruding piece, or the fastening hole is formed in a part of the main standing portion and the protruding piece is provided on the first piece of the separation prevention fastener so as to be mutually coupled.

7. A main carrier mounting mechanism, for a concrete ceiling, the main carrier mounting mechanism having a lightweight steel structure, the main carrier mounting mechanism comprising:

an upper horizontal portion mounted on a rod hanger;

a main standing portion having an upper end integrally coupled to one end of the upper horizontal portion and a lower end extending downward in a direction of gravity to have a length longer than a height of a main carrier;

a lower panel having one end integrally coupled to the lower end of the main standing portion, and an opposite end formed to have a width equal to a width of the main carrier so that the main carrier is seated thereon; and a separation prevention fastener connected to the opposite end of the lower panel and extending toward an opposite end of the upper horizontal portion so as to define an open space, wherein:

the separation prevention fastener includes a first cut-off weak portion at a part of a lower end thereof, so that the separation prevention fastener is coupled to the upper horizontal portion in such manner that a female element receives a male member, when the separation prevention fastener is fastened to a body, an upper fixing piece is provided on an inner surface of a first piece of the separation prevention fastener to fill a space together with one surface of the flange of a lower end of the rod hanger or fill the space together with one surface of a height adjustment nut, so that a tubular adjustment portion or the nut is prevented from being rotated when the separation prevention fastener is coupled to the upper horizontal portion in such manner that the female element receives the male member.

* * * * *